US007152893B2

(12) United States Patent
Pudney

(10) Patent No.: US 7,152,893 B2
(45) Date of Patent: Dec. 26, 2006

(54) HANDLE ASSEMBLY WITH DUAL LATCH FEATURE

(75) Inventor: Richard I. Pudney, Plymouth, MI (US)

(73) Assignee: Key Plastics, LLC, Northville, MI (US)

( * ) Notice: Subject to any disclaimer, the term of this patent is extended or adjusted under 35 U.S.C. 154(b) by 82 days.

(21) Appl. No.: 10/924,124

(22) Filed: Aug. 23, 2004

(65) Prior Publication Data

US 2006/0038417 A1 Feb. 23, 2006

(51) Int. Cl.
*E05B 3/00* (2006.01)

(52) U.S. Cl. ..... 292/336.3; 292/92; 292/347; 292/DIG. 30; 292/DIG. 31; 292/DIG. 65

(58) Field of Classification Search ..... 292/336.3, 292/347, DIG. 30, DIG. 31, DIG. 65, 92, 292/DIG. 92
See application file for complete search history.

(56) References Cited

U.S. PATENT DOCUMENTS 2,196,478 A * 4/1940 Simpson ..... 292/210
2,219,626 A * 10/1940 Johnson ..... 74/535
2,703,729 A * 3/1955 Jakeway ..... 292/336.3
3,544,148 A 12/1970 Sandor ..... 292/336.3
3,606,428 A * 9/1971 Erck et al. ..... 292/336.3
3,652,112 A * 3/1972 Panelli ..... 292/210
3,719,248 A * 3/1973 Breitschwerdt et al. ..... 180/271
3,858,921 A * 1/1975 Kuki ..... 292/336.3
3,967,844 A 7/1976 Torii et al. ..... 292/336.3
4,413,849 A * 11/1983 Davis et al. ..... 292/229
4,883,296 A * 11/1989 Laurie ..... 292/336.3
4,963,503 A * 10/1990 Aoki et al. ..... 438/27
5,123,687 A * 6/1992 Pfeiffer et al. ..... 292/336.3
5,390,517 A * 2/1995 Yamada ..... 70/210
5,408,853 A * 4/1995 Yamada ..... 70/210
5,440,905 A * 8/1995 Yamada ..... 70/208
5,556,145 A * 9/1996 Takasaki ..... 292/336.3
5,560,659 A 10/1996 Dault ..... 292/336.3
5,566,992 A * 10/1996 Anderson et al. ..... 292/241
5,609,373 A * 3/1997 Gromotka ..... 292/229
5,638,709 A * 6/1997 Clavin ..... 70/208
5,664,813 A * 9/1997 Gromotka ..... 292/229
6,382,688 B1 * 5/2002 Agostini ..... 292/336.3
6,471,262 B1 * 10/2002 Schwab ..... 292/336.3
6,606,889 B1 * 8/2003 Tweedy ..... 70/208
6,612,630 B1 * 9/2003 Meinke ..... 292/348
6,668,602 B1 * 12/2003 Graham et al. ..... 70/208
6,698,262 B1 * 3/2004 Wittwer ..... 70/208

* cited by examiner

*Primary Examiner*—Brian E. Glessner
*Assistant Examiner*—Carlos Lugo
(74) *Attorney, Agent, or Firm*—Markell Seitzman

(57) ABSTRACT

A handle assembly (10) is shown. The assembly includes a rotatable, spring handle (12, 120) with a plunger (14, 114) having a first engagement feature or surface (16, 116) for receipt of a spring force; a trigger device (20, 150) in operative connection with the handle; and a blocking member (24, 160) movable with the handle and rotatably mounted on the handle, the blocking member including a latch at a distal end thereof (26, 166). The blocking member is in operative connection with the trigger device and a portion of the latch is retained by a remote retention surface (22) when the assembly is in a locked configuration. Upon sufficient mechanical movement of the trigger device and the blocking member, the latch is no longer restricted by the retention surface.

19 Claims, 8 Drawing Sheets

HANDLE ASSEMBLY WITH DUAL LATCH FEATURE

This application claims the benefit of U.S. Application Ser. No. 10/648,911 filed on Aug. 27, 2003. The disclosure of the above application is incorporated herein by reference.

BACKGROUND AND SUMMARY OF THE INVENTION

The present invention generally relates to latch mechanisms and more particularly to latch mechanisms for vehicle doors and panels. Latch mechanisms are included in a wide variety of applications, including those involving access panels or doors. In a number of instances, for example, additional features may be employed with door handles for a vehicle to provide added protection or safety. Such additional features can be particularly useful in cases where an impact, such as a side impact or rear impact on a vehicle, may occur. The invention provides, among other things, a supplemental latching mechanism that assists in maintaining the reliability of a primary latching mechanism while preventing inadvertent opening of a door, even in the event of an impact or other significant force occurrence.

The present invention comprises a door handle assembly with a movable handle. In the preferred embodiment the handle is configured to be rotationally mounted to a door at one end of the handle. The handle is spring biased causing the handle to lie against the door (its sheet metal or skin) in a rest position. An end of the handle, opposite its pivot end, is displaceable from the rest position relative to the door and movable to an activated position when the handle is grasped and pulled by a user seeking entry (into the vehicle) through the door.

The spring bias can be realized in a number of ways; in the preferred embodiment of the invention the spring bias of the handle is obtained using a known type of bell crank (a pivoted, double lever mechanism). The handle comprises a projection (an engagement surface) to receive the bias force transmitted by one of the levers of the bell crank. As can be appreciated the interface between the mechanism, such as a spring that biases the handle to its rest portion and the handle, can take many forms. For example, the handle bias spring can be directly connected to the handle rather than acting through an intermediary mechanism or engagement surface.

When the handle is moved sufficiently away from the door, a door latch (sometimes referred to in the art as a door lock) is moved to an open condition and the door is now unlatched and ready to be pulled open. As can be appreciated, the handle can act directly on the door latch or indirectly through a cable or bar, as the handle and door latch are often remotely located.

The handle assembly further includes a blocking member also referred to as a latch member. The blocking member is rotationally fixed in the handle and carried by the handle. The blocking member includes a latch or hook latchable with a fixedly positioned latch surface, wall or feature provided by a cooperating member (fixedly attached to and movable with the door). The cooperating member is the cap or lock housing of the handle, which is fixedly secured to the sheet metal of the door and in general also functions, in part, as an aesthetic trim part of the handle assembly. The latch surface need not be formed as part of the cap or lock housing but also be realized by a part of the door sheet metal. With the blocking member in place, the door handle cannot be moved from its rest position to open the door.

The handle assembly further includes a spring-loaded activation member (also referred to as a trigger or trigger device) carried by the handle and in part displaceable relative to the handle and displaceable relative to the blocking member (also carried by the handle). Movement of the activation member moves the blocking member away from the latch surface to a disengage position. The activation member can be directly biased or loaded by a biased spring or indirectly loaded or biased with the spring acting, for example, on the blocking member. With the blocking member dislodged from the latch surface, the door handle is now capable of being pulled away from the door to unlatch the door latch and permit the door to be opened. In the illustrated embodiments of the invention the activation member is configured as a bar or lever rotationally fixed at one end, with the other end of the bar or lever in engagement with an extending lever of the blocking member. The activation member is located on the underside of the handle and depressible inwardly (relative to the handle). As can be appreciated, the rotatable activation member can replaced by a linearly movable button mounted to the underside of the handle, which directly moves the blocking member, or by a combination of a button mounted on the top of the handle and a cooperating lever member that moves the blocking member.

The blocking member can further include an inertial mass, which increases the latching effectiveness of the handle. During a side impact crash in a vehicle, the inertial forces act on the inertial mass, generating a torque that causes the blocking member to be urged against the latch surface preventing the blocking member from becoming dislodged from the latch surface.

Many other objects and purposes of the invention will be clear from the following detailed description of the drawings.

DETAILED DESCRIPTION OF THE DRAWINGS

Figure 1:
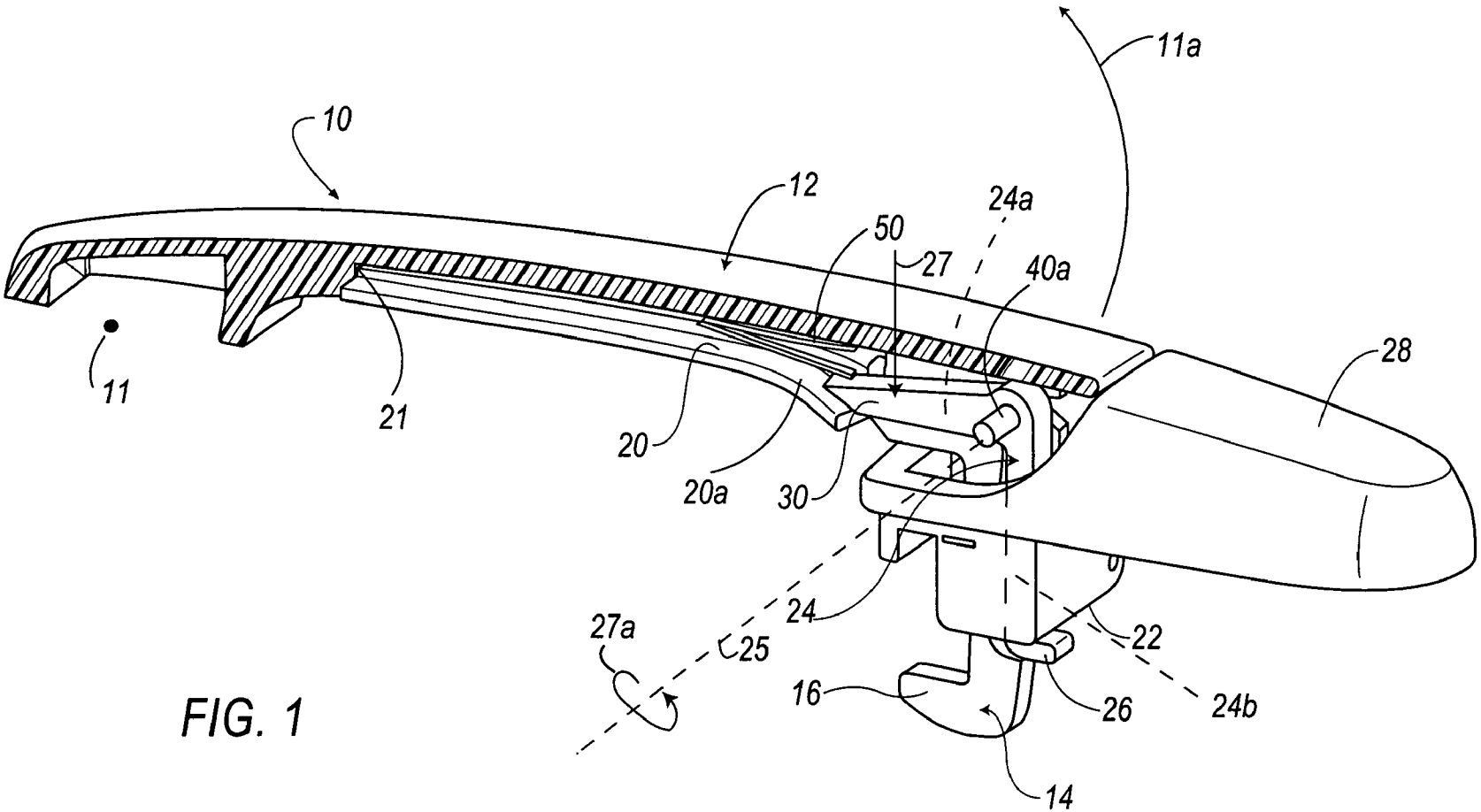
FIG. 1 is a front perspective view of an assembly with a dual latch feature that embodies teachings of the present invention with a portion of the handle shown in cross section.

The following description of embodiments of the invention is merely exemplary in nature, and is not intended to limit the invention, its scope, applications or uses.

Referring to FIGS. 1–4, an illustrative embodiment of a handle assembly 10 constructed in accordance with the teachings of the present invention is shown.

Handle assembly 10 includes a rotatable, spring-loaded handle 12 having a plunger 14 with a first engagement feature or surface 16. The plunger 14 and the first engagement feature or surface interface with a bell crank to bias the handle to a rest position. The handle 12 is configured in a known manner to rotate about a center of rotation 11. The direction of rotation of the handle, when pulled by a user, is shown by numeral 11*a*. The handle 10 and the plunger 14 are preferably of one-piece construction and comprised of metal, plastic, rubber or various combinations of the foregoing elements. However, it should be noted the handle 10 or plunger 14 may be comprised of almost any material configurations and combinations that can provide the necessary function and sufficient durability.

In the first embodiment, the first engagement feature or surface 16 is shown in the form of an L-shaped surface or hook. However, the plunger and first engagement feature or surface are not limited to the illustrated configuration and may instead take on a number of alternate configurations provided the desired latching function can be achieved. The assembly 10 additionally includes an activation member (trigger or trigger device) 20 that is in operative connection with the handle 12. The activation member (trigger device) 20 may be in the form of a movable bar, lever, handle strip or lever grip portion (such as shown), or may instead be comprised of a movable button (see FIG. 9) or other actuation mechanism that is lifted, depressed, or otherwise actuated by a user to actuate an associated latch. As shown the activation member 20 is essentially a bar (lever) configured to rotate about its end 21. The activation member 20 can be a separate component in association with the handle 20 (as shown) or, if desired, the activation member 20 can instead be formed integrally with the handle 12. In a preferred embodiment, the handle 12 and activation member 20 are configured to resist the intrusion of weather elements therebetween by using tight fitting joints as known in the art.

Figure 9:
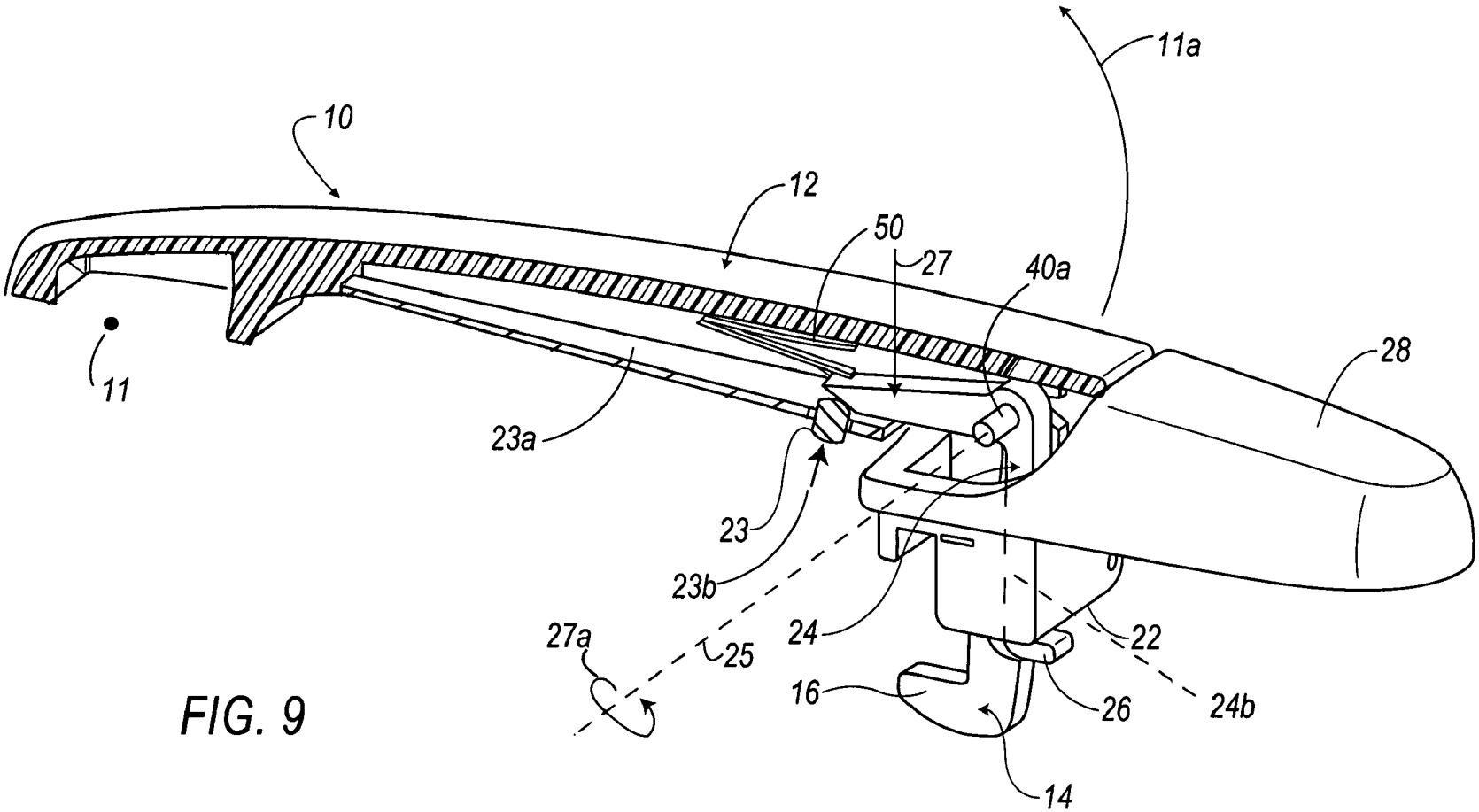
FIG. 9 shows an alternative embodiment of the invention in which the activation member is configured as a button.

Reference is briefly made to FIG. 9, which shows an activation member configured as a movable button 23. In this embodiment the lever-type activation member 20 is replaced by a fixedly positioned support member or plate 23*a* secured to the underside of handle 12. The support member includes an opening for receipt of a manually depressible button 23. Inward movement (in the direction of arrow 23*b*) of button 23 causes the blocking member 24 within its latch 26 to uncouple from surface 22.

Returning to FIGS. 1 and 2, the assembly 10 further includes a blocking or latch member 24 having a retaining feature or latch 26 (latchable with the retention surface 22) latchable with a remote latch or retention surface. As illustrated the latch or retention surface 22 is-formed within a mating handle connection component such as a cap 28 (or in lock housing 128 that receives a door key). The latch surface 22 may be part of any sufficiently rigid component or structure to provide a structure or surface for securing or retaining the retaining feature or latch 26. The latch 26 may be arcuately shaped or hook-like in the form of a J-shaped hook (see FIG. 5) or L-shaped "hook" (such as shown in FIGS. 1 and 2), or may instead take on any configuration that is capable of providing sufficient retention and release of the second latch member 24.

In a preferred embodiment, at least a portion of the blocking member 24 is rotationally supported by the handle and is movable from a rest position to an activated position when activated by the activation member 20. For example, as generally illustrated, the blocking member 24 is configured as a bell crank having a first lever portion 24*a*, a second lever portion 24*b* and a pivot axel 40 (comprising two oppositely extending stub axels such as 40*a* and 40*b*) in FIG. 1. An end portion 20*a* of the activation member 20 contacts or is operatively in communication with the first lever portion 24*a* (also identified as end portion 30) of the blocking member 24. The bell crank and more particularly the stub axels 40*a* and 40*b* are rotationally supported in or relative to the handle 12. For example, each stub axle can be received within a bushing 13 formed in opposing sides 15*a* within a hollow end 12*a* of the handle 12 generally above the plunger 14 as shown in FIG. 2. Alternate ways of rotationally supporting the blocking member are within the scope of the present invention. The lever 24*b* of the blocking member 24 is movable in and out of the notch 34 in the plunger 14.

Additionally, for some applications the first engagement surface 16 and the retaining feature 26 are configured to face away from one another or, for instance, they may contact diametrically opposing surfaces. Such a configuration can provide a measure of added safety in that if a force jars the assembly in a direction away from the engagement of the first or second retaining feature, the other feature may become further engaged and prevent an undesired release of the handle.

Figure 2:
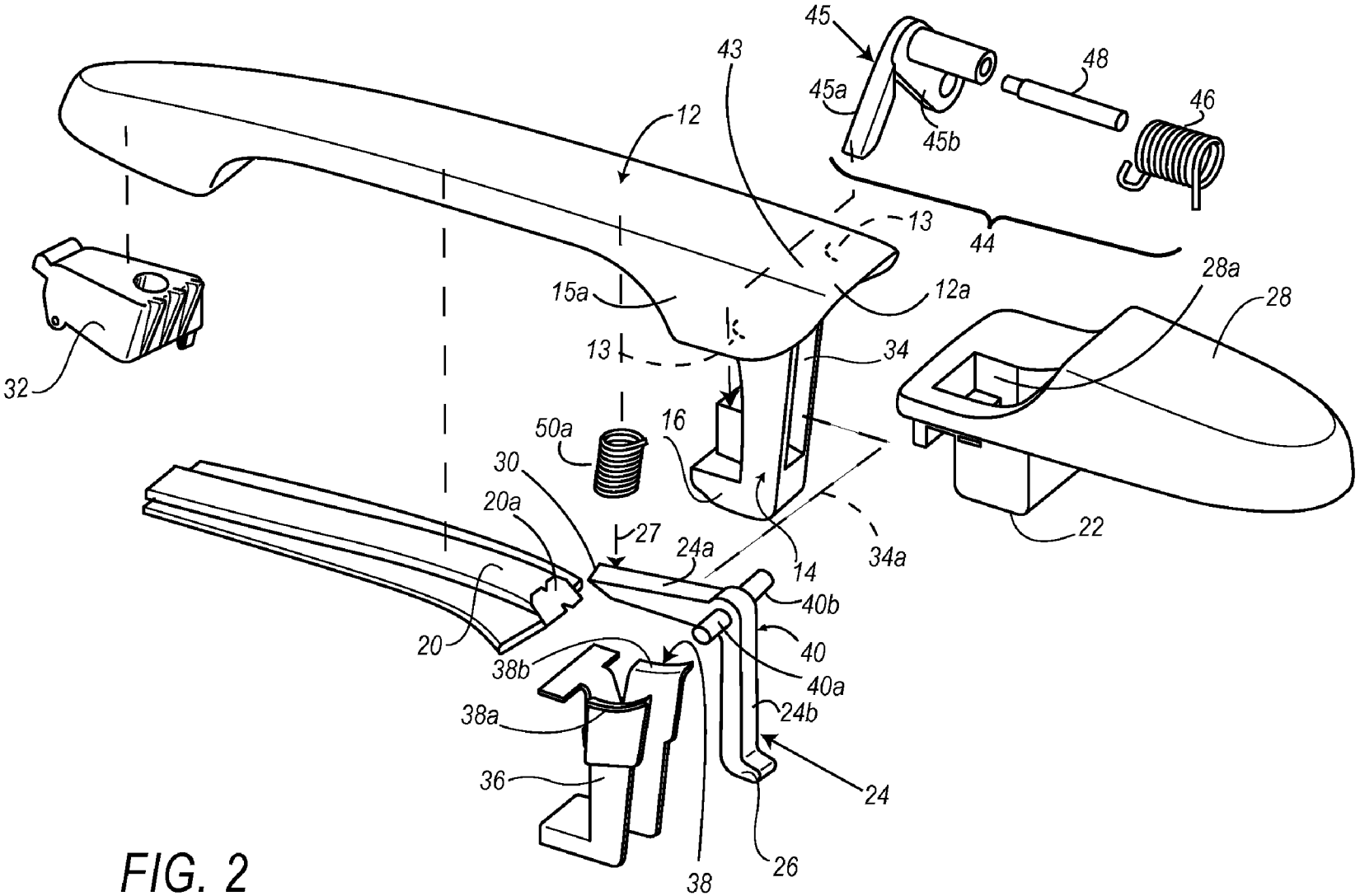
FIG. 2 is an exploded view of various components of the exemplary assembly illustrated in FIG. 1.

In a "locked" or "engaged" configuration, that is with a cooperating door (not shown) closed, such as shown in FIG. 1, the retaining feature (latch) 26 of the blocking member 24 extends in locking engagement over, or is otherwise retained or movably restricted in at least one direction by a portion of retention surface 22. Ideally, there will be a sufficient overlap or interference in the desirably engaged configuration to prevent unintentional release or disengagement. It is however noted that although the exemplary retention surface 22 is illustrated in the nature of an outer ledge or edge surface, the retention surface 22 may instead take on other forms or configurations such as, for example, without limitation, a surface associated with a notch or a protrusion.

In the assembly 10 shown, upon engagement the retaining feature 26 and the retention surface 22 provide a mechanism to prevent the handle 12 from being pulled away from the door. One skilled in the art will appreciate the blocking member 24 can provide a measure of additional protection against unintended activation of the handle 12, for instance, when a sufficiently high level of accelerative force (also referred to as a G-force) is applied in a direction normal to the handle.

As mentioned, the handle 12 is biased to a closed position by operation of a bell crank or bell crank mechanism 44 of conventional design, which is typically located within the door supporting the handle 12. The bell crank mechanism 44 includes a bell crank 45 having levers 45*a* and 45*b*, a first spring 46 and a pin 48. When the door (not shown) is closed, lever 45*a* biases the handle 12 via the first engagement surface 16 inwardly relative to the door to the closed or rest position of the handle. Phantom line 43 shows the force path of the lever 45*a* biasing the first engagement surface 16. Lever 45*b* is connected directly or indirectly via a cable or bar to the door latch of known variety. In the illustrated embodiments, it is not possible to merely lift the handle 12 and cause the door to unlatch and open while the latch feature 26 (of the blocking member) is maintained in a blocking position with surface 22 (see FIG. 1 or 3) thereby preventing outward movement of the handle 12.

As will be shown below, the latch 26 is moved to a release position that is disengaged from the retention surface 22 as a consequence of moving the activation member 20 inwardly and rotation of the blocking member 24. Sufficient mechanical movement of the activation member 20 causes the blocking member 24 rotate about axis 25. As the latch 26 moves it becomes disengaged from the retention surface 22. More particularly, inward movement (which is typically a pivot action) of the activation member 20 urges end 20*a* (of the activation member) to push end 30 of lever 24*a* upwards (further into the handle) against the bias force of a spring 50 (or 50*a*) mentioned below, which causes the retaining feature 26 to disengage from surface 22.

While not limited to the exemplary configuration of an assembly 10 shown, to unlatch the handle 12 in FIG. 1, a user is generally required to pull the handle 12 and to also actuate (e.g., push or depress) the trigger device 20 to unlatch the handle 12. If the user does not actuate the trigger device 20 and consequently the blocking member 24, the latch 26 will not disengage from the retention surface 22, and the handle 12 will generally be prevented from being pulled away from the retention surface 22.

In addition to the first or main spring 46, which is part of the bell crank 44, the assembly 10 includes a second spring means associated with the activation member (trigger device) 20 and blocking member. This second spring 50, 50*a* can take many forms and can be positioned within the hollow handle 12 to bias end 30 of the bell crank lever 24*a* in the direction of arrow 27 to rotate the bell crank in a counterclockwise direction (see arrow 27*a*) about axis 25. A leaf spring 50 is shown in FIG. 1 while a helical-spring 50*a* is shown in FIG. 2.

From a force perspective, it is typically desired that the force associated with the main spring 46 is greater than the force associated with the second spring 50 or 50*a*, such that in engineering terms, there is less resistance or a lesser mechanical advantage associated with the lesser spring means. As used herein the term spring means may or may not include the inclusion of one or more springs, and may instead be comprised of other mechanical components that provide a spring-like effect.

FIG. 2 illustrates an exploded view of an assembly 10. In addition to more specifically detailing certain features or nuances associated with some preferred embodiments of the components or elements already mentioned or discussed in connection with the assembly of the previous figure, the instant figure further also depicts additional elements that can be employed. For instance, without limitation, FIG. 2 generally illustrates an example of an additional, and optional, mating component 32 for interconnection or communication with and support of the handle 12. Component 32 assists in rotationally supporting the handle 12 relative to the door. FIG. 2 also depicts the plunger 14 being formed with a notch 34 (which is defined to include an aperture, recess, groove or notch) for receiving a portion of the blocking member 24. Phantom line 34*a* shows the relative position of the second latch member relative to the handle and the notch 34. For example, on assembly the lever 24*a* is inserted within the hollow end 12*a* of the handle, and the axles 40*a* and 40*b* situated on the bearings 13 of the handle. The lever 24*b* of the blocking member 24 will be biased away from the notch 34 and will move in and out of the notch 34 relative to surface 22.

FIG. 2 additionally provides an illustration of an embodiment of an optional separate bracket 36. The bracket 36 acts as a sleeve and is positioned in front of and about the sides of the plunger 14 and can be useful in eliminating or lessening sliding friction between the plunger 14 and the walls 28*a* about an opening in cap 28. In the preferred embodiment the bracket is made of a low-friction plastic. The bracket 36 can include a pivot surface 38 at its top, which provides for operational communication with the blocking member 24. In the exemplary embodiment, one or more pivot surfaces 38*a*, 38*b* on the bracket 36 provide an alternate pivot point/surface (e.g., as a lever or rotation point) for supporting the stub axle portions of the blocking member 24. In this embodiment, the stub axles 40*a* and 40*b* can extend over or otherwise be placed in mechanical connection with pivot surfaces 38*a*, 38*b* to permit the blocking member 14 to have a degree of movement or rotation about the pivot surface, and consequently, a portion of the blocking member 14 (e.g., latch 26) will have a degree of movement (linear or rotational) relative to the associated retention surface 22.

Figure 3:
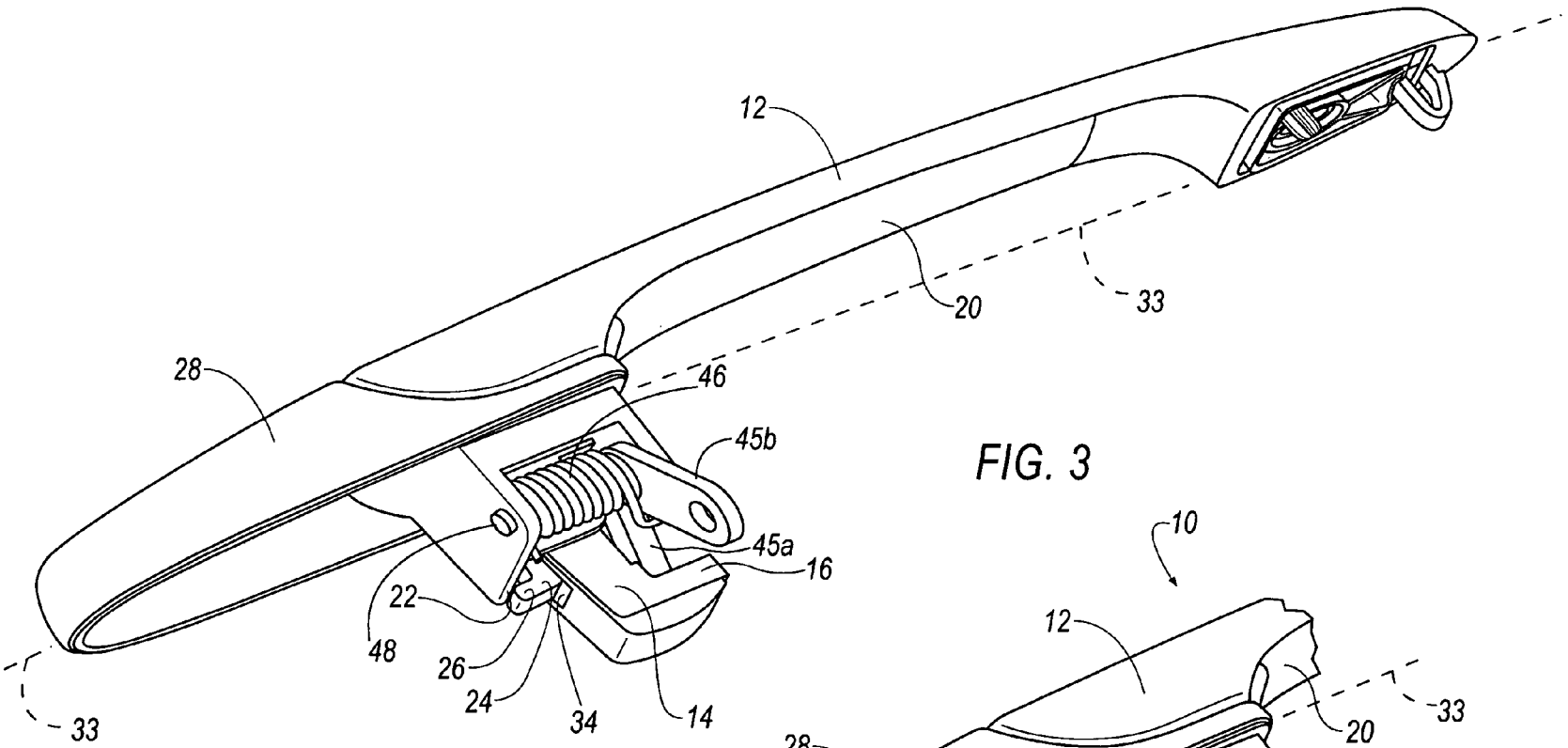
FIG. 3 is a rear perspective view of the assembly shown in FIG. 1, which generally illustrates the second retaining feature in an engaged configuration.
Figure 4:
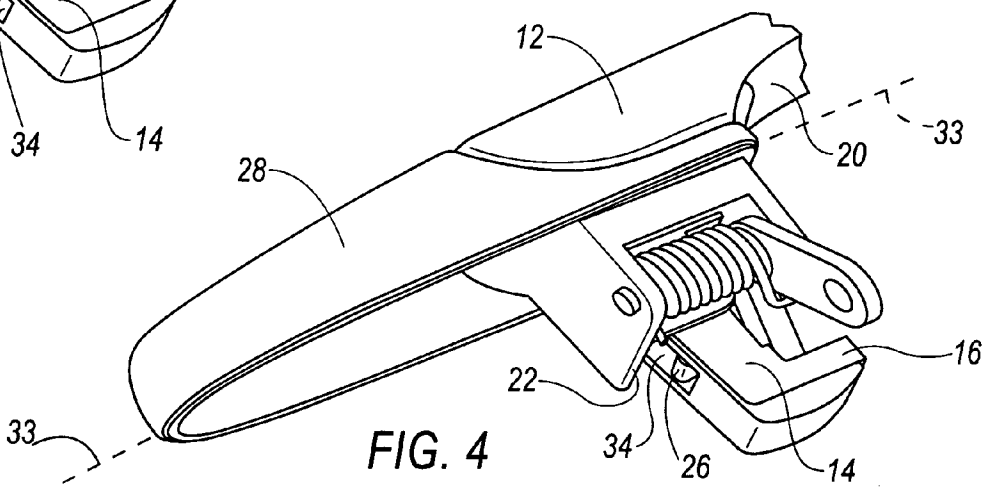
FIG. 4 is a rear perspective view of the assembly shown in FIG. 1 shown slightly turned and generally illustrating the second retaining feature in an unengaged configuration.

FIG. 3 shows the handle assembly 10 in a configuration that corresponds to the door being shut. As depicted, latch feature 26 is engaged with retention surface 22 and will prohibit the movement of the handle 12, outwardly, such as away from the sheet metal forming the door 33 (shown in phantom line). FIG. 4 shows the assembly in an 10 unengaged configuration, which is achieved when the door is manually opened. As can be seen, the lever 24*b* of the blocking member 24 has been moved into the notch 34 of the plunger 14 and has disconnected from the surface 22.

Figure 5:
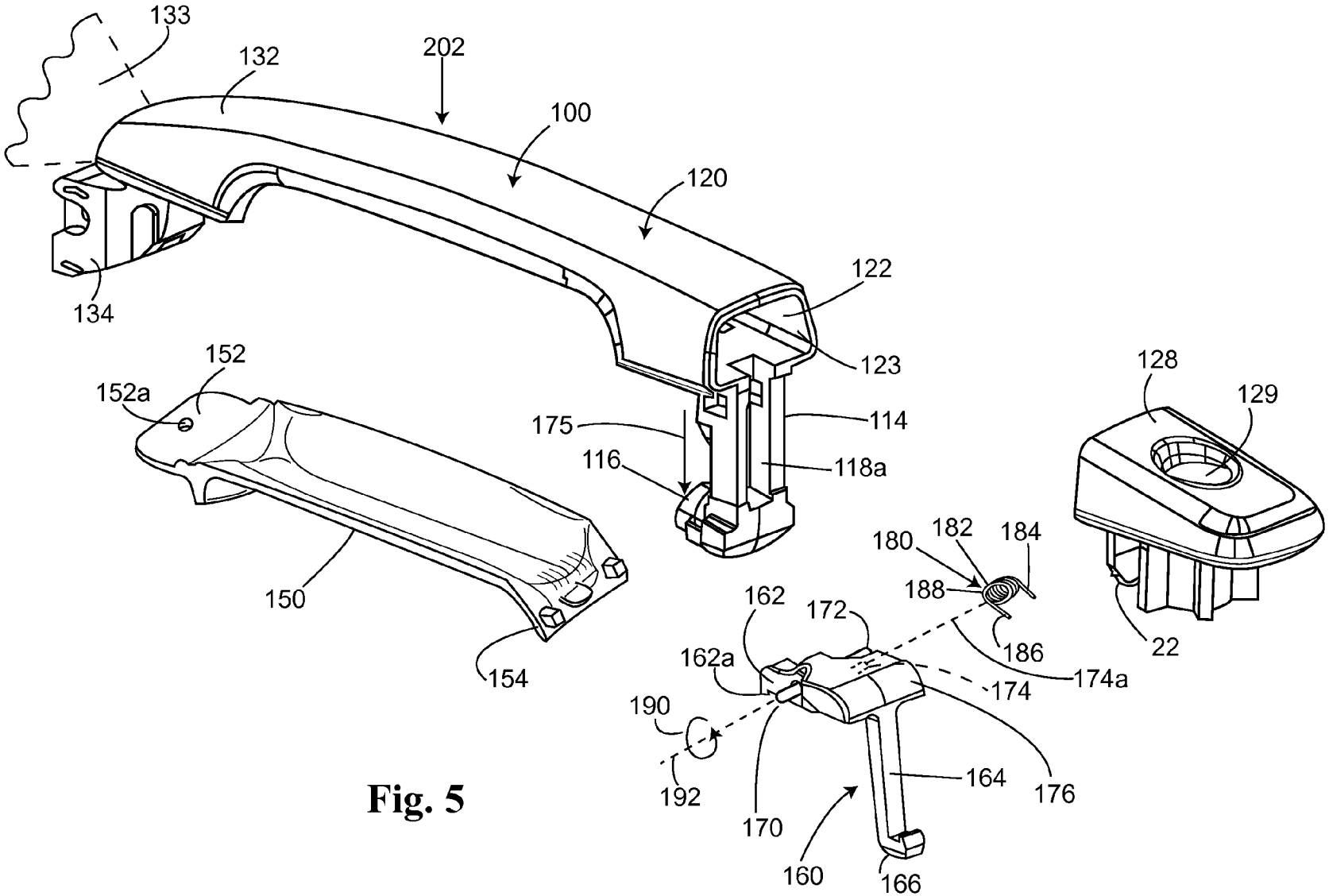
FIG. 5 illustrates the major components of an alternate embodiment of the present invention.
Figure 6B:
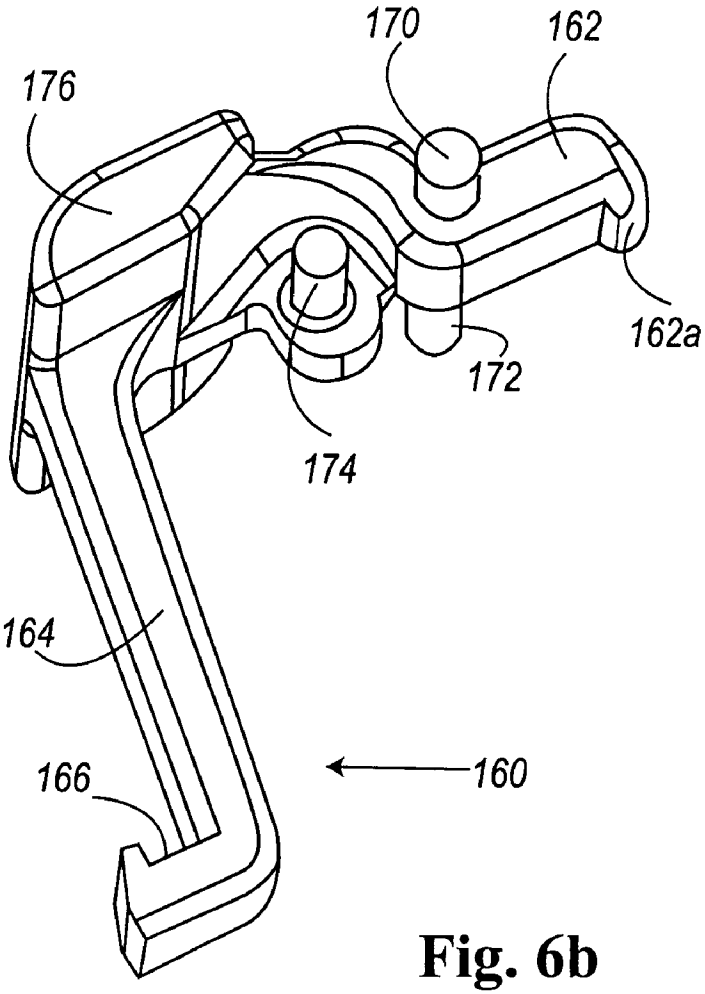
FIGS. 6 and 6*a* show an alternate embodiment of a second retaining feature.
Figure 6A:
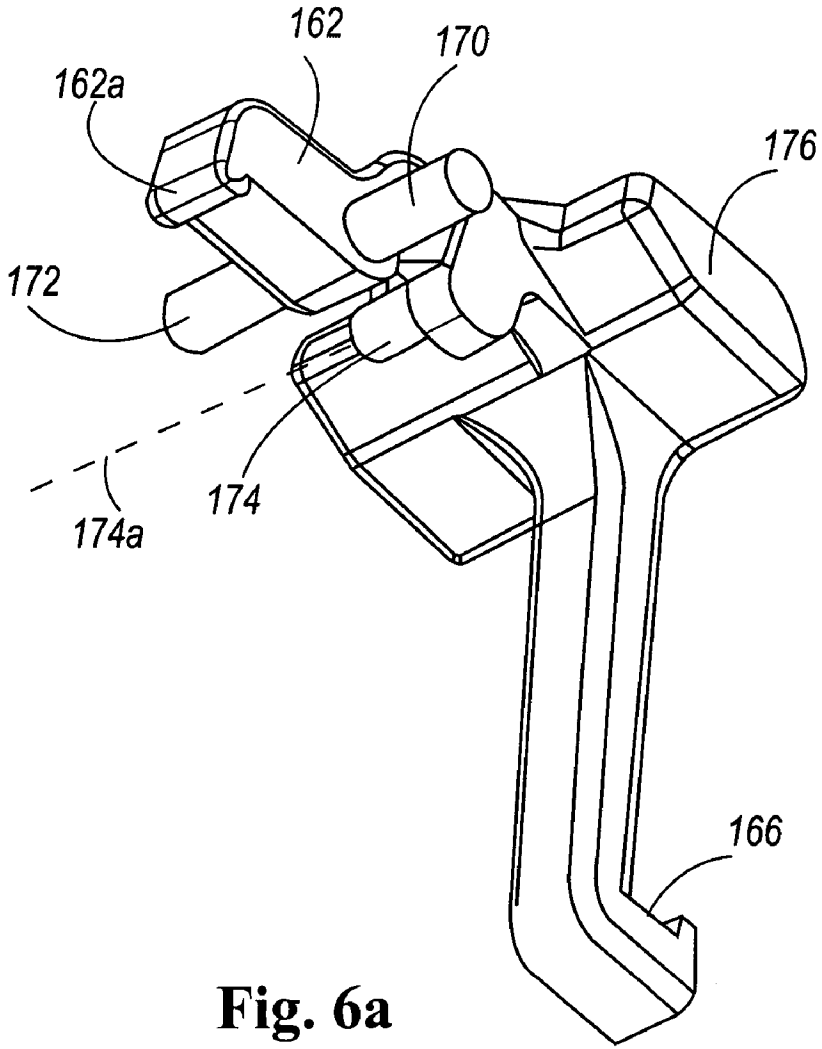
Figure 7:
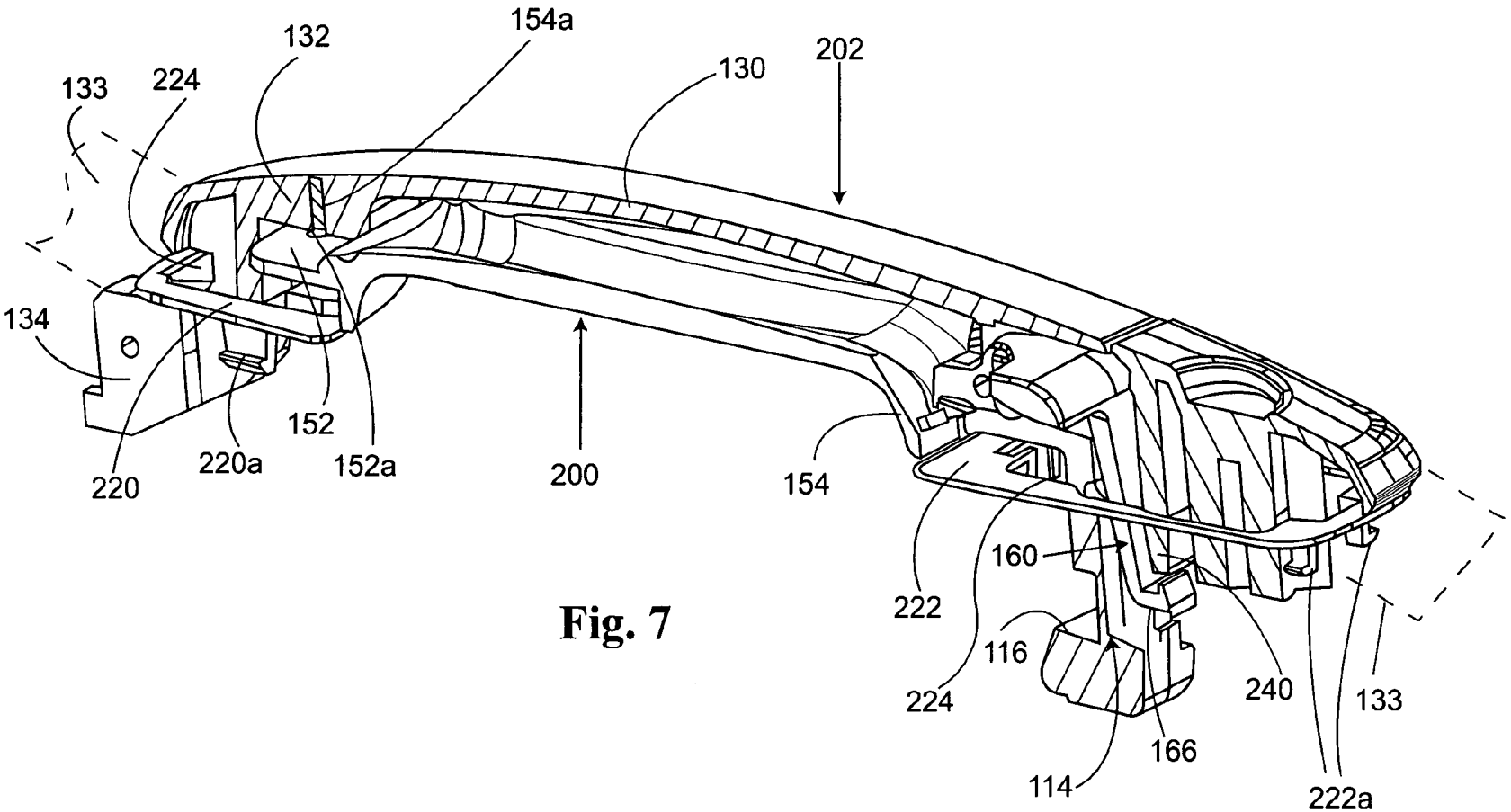
FIG. 7 is longitudinal cross-sectional view of this alternate embodiment.

Reference is now made to FIGS. 5–7, which illustrate an alternate embodiment of the invention including an alternate handle assembly 100 including a rotatable, spring biased handle 120. The handle 120 includes a hollow first end 122 adapted to mate with a corresponding connecting component such as a lock housing 128 similar to cap 28 such as illustrated in FIGS. 1–4). The lock housing 128 is shown with an opening 129 therein to illustrate the location of an optional key cylinder, if used. The handle 120 includes an extending bar or plunger 114 with a corresponding optional engagement feature or surface 116 (also realized by a projecting structure) operatively connected to a bias spring such as 46. The plunger 114 also includes a notch or hollow groove or slot 118*a*. This construction is similar to that shown in FIGS. 1–4. As can be seen, the shape of the surface 116 (concave downward forming an L-shaped hook) differs from that of the shape of surface 16 (straight forming an L-shaped hook) but they are functional equivalents of each other. As before, one of the levers such as 45*a* of the bell crank 45 exerts a downward bias force on the surface 116 as illustrated by arrow 175. As mentioned above, the handle can be connected to the bias spring in alternate ways.

The handle 120 is generally hollow and includes a central, grasping or holding portion 130, which is formed as a thin, curved rib as also illustrated in FIG. 7. The rear or pivot end 132 of the handle 120 is rotationally supported in the door (shown as phantom line 133) in a known manner. As illustrated, the handle includes an integral pivot member 134 rotationally or slidingly received within a mating part of the door in a known manner. As can be seen in FIGS. 5 and 7, the pivot member 134 is typically located below the sheet metal of the door 133. The handle assembly 100 also includes an activation member or trigger 150. The activation member 150 is preferably a plastic molded lever and is pivotally connected to the handle 120 at a connection end 152 secured to the underside of end 132 of the handle.

The activation member 150 is secured to the handle by a pin or threaded fastener 154*a* (as shown in FIG. 7). As can be appreciated, the activation member (trigger) 150 generally pivots about the fastener 154*a* (received through opening 152*a*), which acts as a fulcrum. The trigger 150 includes an opposite end, which functions as an activation lever and is generally identified by numeral 154. Inward movement of the activation member, trigger or lever 150 moves the blocking member 160 to a release condition (similar to the manner in which blocking member 24 was moved). The blocking member 160 has, in general, the same function as member 24. The blocking member 160 includes a first lever 162 similar in function to lever 24*a* in the earlier embodiment. The blocking member 160 further includes another lever 164 similar in function to lever 24*b*. A retaining feature or latch 166 is formed at the distal end of lever 164 and is similar in function to retaining feature or latch 26, however, the shape of the retaining feature 166 is arcuate and includes a U-like or J-like shape. Blocking member 160 further includes two opposing stub axles 170 and 172 (shown in FIGS. 5, 6*a* and 6*b*), which are similar to axels 40*a* and 40*b* of the blocking member 24. For the purpose of illustration in FIG. 7, the handle 120, plunger 114, and lock housing 128 are shown in cross-section while the activation member 150 and blocking member 160 are shown in isometric view. As can be seen from FIGS. 6*a* and 6*b*, the blocking member 160 additionally includes a third stub axle 174, which extends only from one side thereof on which the torsion spring 180 is received.

The bias spring 180 includes a body 182 and ends 184 and 186. Spring 180 is configured as a torsion spring having a central passage 188 through body 182. Spring 180 is mounted coaxially along an axis 174*a* (which extends through stub axel 174) and is received upon the stub axle 174 before the blocking member 160 is inserted within the end 122 of the handle 120. The spring 180 biases the latch 166 (blocking member) into engagement with retaining surface 22. One end of spring 180, such as 184, pushes on the blocking member 160 while another end of the spring, such as 186, is mounted within a cavity 123 forming hollow end 122 of handle 120 and reacts against an inner surface of this hollow end 122 causing the blocking member 160 to be biased in a counterclockwise manner as shown by arrow 190 about axis 192 (which extends through the axles 170 and 172) to place latch 166 in locking engagement with surface 22.

The blocking member 160 further includes an enlarged mass (inertial mass) portion 178 positioned between the axels 170 and 172 and the lever 166. As can be seen in the various figures, this mass or inertial mass portion 176 is at or near the rear of lever 162 and positioned at the top of lever 164.

The operation of this embodiment is substantially similar to the earlier embodiment. When in a rest position the various parts will be configured as illustrated in FIG. 7 with the blocking member (latch 166) in locking engagement about surface 22. Also in this rest portion, the bell crank lever 45*a* (or other bias mechanism) urges the handle toward the rest position. As illustrated, the lever 45*a* presses against plunger 114 (the upper surface of the retaining feature 116) urging the handle 120 to pivot into the interior volume of the door 133 and to rest against the door.

To release the door, during normal operation, the operator grasps the handle and more particularly applies an inward (relative to the handle) force (see arrow 200 of FIG. 7 to the activation member 150), which causes the activation member 150 to pivot about its end 152. The motion of the activation member (trigger) 150 causes end 154 to push on end 162*a* (of lever 162) to lift lever 162 against the force bias spring 180, causing the blocking member (latch 166) to rotate relative to axis 192. Because of the geometry of the blocking member 160 and, in particular, the location of the axles 170 and 172, the rotation of the blocking member 160 causes the latch 166 to move on an arc downwardly and away relative to latch surface 22. The disconnection of the latch 166 from surface 22 permits the user to then rotate or pull the handle 120 about its pivot 134, thereby causing the bell crank 45 to rotate in opposition to the bias force of its spring 46 to unlatch the latching or locking mechanism associated with the vehicle door and open the door.

During an accident inertial forces, see arrow 202 for example, act upon the door. The inertial force causes the blocking member 160 to move oppositely, such movement accentuated by the placement and weight of inertial mass 176, which urges the latch 166 to remain in contact with surface 22, thereby keeping the handle 120 in a locked condition and preventing the handle from inadvertently opening.

Figure 8:
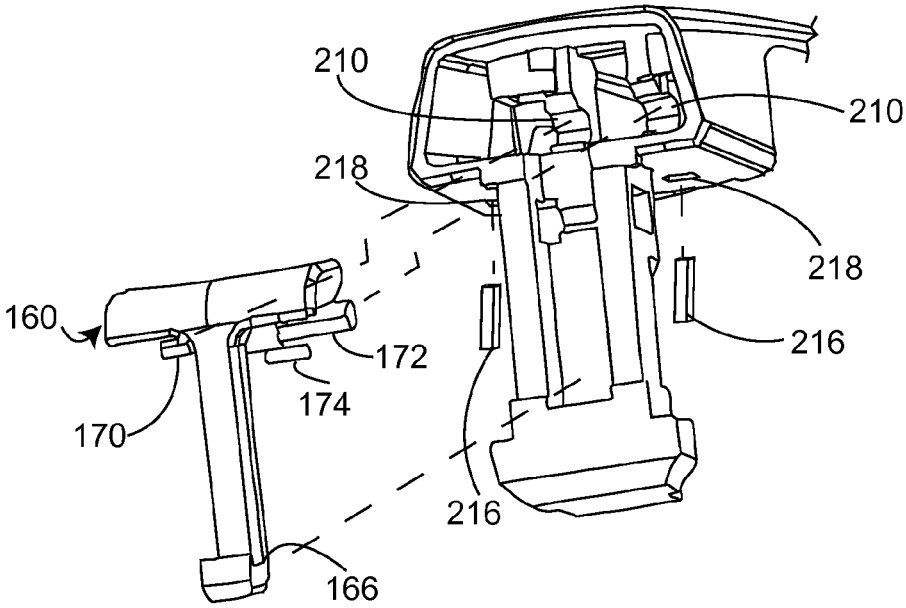
FIG. 8 is a partial assembly view showing a bearing within a portion of the handle about which a second latch member rotates.

During assembly, the blocking member 160 and more particularly the axles 170Q and 172 are inserted within the hollow end 122. As mentioned, the handle 120 is formed at cavity 123. The hollow end includes a provision to rotationally support the axles 170 and 172. For example, the cavity 123 is configured to include complementary bushing surfaces 210 (similar in function to bushings 13), shown in FIG. 8, to rotationally receive the axles 170 and 172. The axels are retained within the cavity 123 handle by a retention mechanism that can take a variety of forms such as a spring clip, a cotter pin, flexible tabs formed on the interior of the hollow end 122, or by retention pins 216 pressed through a wall 218 (or opening on the wall) of the handle after the axles 170 and 172 are in place.

Reference is again made to FIG. 7. The pivot end 132 of the handle and the lock housing 128 are each respectively shown positioned above a corresponding snap-in gasket or seal 220 and 222 respectively which are placed on the door sheet metal adjacent to openings in the sheet metal. Each gasket 220 and 222 respectively acts as a seal between the handle 120 and lock housing 128 and the sheet metal of the vehicle door. Each shield 220 and 222 includes an opening 224 (aligned with a corresponding opening in the door) through which a portion of the handle 120 and/or lock housing 128 extend. Each gasket 220 and 222 respectively includes one or more snap-in connectors 220*a* and 222*a*, which permits the gasket to be snapped into a corresponding opening (not shown) in the sheet metal of the door.

Many changes and modifications in the above-described embodiment of the invention can, of course, be carried out without departing from the scope thereof. Accordingly, that scope is intended to be limited only by the scope of the appended claims.

The invention claimed is:

1. A handle assembly (10, 100) for use with a vehicle, the handle assembly comprising:

a spring biased handle including movable first handle member (12) and stationary second handle member (28), the first handle member including a body, first end, second end, a top and a bottom, the first handle member including an extending member (114) generally at one of the first or second end of the first handle member which extends away from the body of the first handle member, the second handle member configured to be secured to a portion of the vehicle, the second handle member having an opening therethrough configured to receive the extending member and having a retention surface, the first handle member reciprocatively movable relative to the opening in the second handle member;

an activation member (20, 150) in operative connection with the handle;

a blocking member (24, 160) including the retaining feature (26, 166) configured to latch with the retention surface (22), the blocking member moved by the activation member;

wherein the blocking member is rotationally movable within a hollow portion of the extending member and configured to be retained by a portion of the retention surface when the assembly is in a first configuration; and further wherein, upon sufficient movement of the activation member and the blocking member, the retaining feature is not restricted by the retention surface.

2. An assembly as recited in claim 1, wherein the first handle member includes a pivot end (32, 132) about which the first handle member can rotate, wherein the extending member (14, 114) is located opposite the pivot end.

3. An assembly as recited in claim 1, including at least one spring means (46, 50, 50*a*) for biasing at least one of the first handle member and the blocking member.

4. An assembly as recited in claim 3, wherein at least one spring means includes a first spring means for biasing the first handle member and a second spring means for biasing the blocking member, the force associated with the first spring means is greater than the force associated with the second spring means.

5. An assembly as recited in claim 2, wherein the second handle member is one of a cap (28) and lock housing (128), fixedly positioned relative to the handle.

6. An assembly as recited in claim 1, wherein the retaining feature (26, 166) is selected from the group consisting of a J-shaped latch, and curved latch.

7. An assembly as recited in claim 1, wherein the blocking member (24, 166) includes an extending lever portion in communication with the activation member and another lever portion that, in an engaged configuration, is in mechanical communication with the retention surface.

8. An assembly as recited in claim 1, wherein the opening in the second handle member is aligned with an opening in a cooperating door of the vehicle upon which the assembly is mounted and wherein the extending member is configured to extend from the bottom of the first handle member through the opening in a cooperating door, the extending member including a hollowed portion (34, 118*a*) configured to receive a portion of the blocking member.

9. An assembly as recited in claim 1, wherein the blocking member is comprised of a two-sided mechanical lever (24*a*, 24*b*; 162, 164).

10. An assembly as recited in claim 1, wherein the activation member is selected from the group consisting of a lever, a button and an actuation mechanism.

11. An assembly as recited in claim 1, wherein the activation member is integral with the handle.

12. An assembly as recited in claim 1, wherein the extending member includes an engagement surface and the blocking member includes a latch with hook-type feature, the engagement surface and the said hook-type feature substantially facing in opposing directions.

13. The assembly as recited in claim 1 wherein the blocking member includes an enlarged mass (176) proximate a pivot (40) thereof and remote from the retention surface, the enlarged mass operatively connected to the activation member and configured to resist movement of the activation member when subjected to levels of acceleration achievable in a crash.

14. An assembly as recited in claim 1, including a support structure (36), receivable in the hollow portion of the extending member, that at least partially connects to or supports the blocking member.

15. An assembly as recited in claim 14, wherein the support structure includes at least one pivot surface.

16. An assembly as recited in claim 15, wherein the blocking member includes an extension that is in mechanical connection with the pivot surface.

17. An assembly as recited in claim 1, wherein the activation member is located adjacent the bottom of the first handle member, the activation member configured to be manually moved from a rest position slightly apart from the first handle member to an activated position adjacent the first handle member.

18. An assembly as recited in claim 1, wherein the activation member is located adjacent a recessed portion at a bottom region of the handle, the activation member configured to be manually moved from a rest position slightly apart from the handle to an activated position adjacent the handle.

19. An assembly (10, 100) for a door (133) comprising:

a spring biased handle (12, 120) including a plunger (14, 114) extending below a surface of the door, the plunger including a hollowed portion (34, 118*a*), the handle including a pivot end opposite the plunger, the plunger configured to pass through an opening in a second handle member and an aligned opening in the door;

an activation device (20, 150) in operative connection to and movable with the handle;

a blocking member (24, 160) rotationally supported within the hollow portion of the plunger and including a latch configured to latch upon a remote retention surface (22) of the second handle member;

wherein, upon sufficient mechanical movement of the activation member and the blocking member, the latch is no longer restricted by the retention surface.

* * * * *